US007833145B2

(12) United States Patent
Ko

(10) Patent No.: US 7,833,145 B2
(45) Date of Patent: Nov. 16, 2010

(54) EXERCISE PEDAL

(76) Inventor: Ming-Jen Ko, No. 92, Hsia Li Rd., Hsia Li Tsun, Hsienhsi Hsiang, Changhua Hsien 50742 (TW)

( * ) Notice: Subject to any disclaimer, the term of this patent is extended or adjusted under 35 U.S.C. 154(b) by 0 days.

(21) Appl. No.: 12/608,594

(22) Filed: Oct. 29, 2009

(65) Prior Publication Data

US 2010/0167886 A1 Jul. 1, 2010

(30) Foreign Application Priority Data

Dec. 31, 2008 (TW) ..... 97223744 U

(51) Int. Cl.
*A63B 26/00* (2006.01)

(52) U.S. Cl. ..... 482/142; 482/146; 482/34; 482/123

(58) Field of Classification Search ..... 482/121–130, 482/148, 140, 142, 146, 34, 139, 51, 907–908; D21/662, 686, 690
See application file for complete search history.

(56) References Cited

U.S. PATENT DOCUMENTS 3,895,794 A * 7/1975 England ..... 482/146
4,826,159 A * 5/1989 Hersey ..... 482/146
5,672,144 A * 9/1997 Hulme ..... 482/140
6,705,977 B1 * 3/2004 Ziak ..... 482/146
6,872,175 B2 * 3/2005 Lin ..... 482/146
6,945,920 B1 * 9/2005 Kemery et al. ..... 482/146
7,052,449 B2 * 5/2006 Chen ..... 482/146

* cited by examiner

*Primary Examiner*—Lori Baker
(74) *Attorney, Agent, or Firm*—Alan Kamrath; Kamrath & Associates PA

(57) ABSTRACT

An exercise pedal includes a plate member including a receiving cavity fixed on a bottom surface thereof, with the receiving cavity including a plurality of partitions to space a number of recesses. A seat formed in a semicircle shape is retained to the recesses to be horizontal or to be vertical either upside down or right side up according to the demands of the user, such that the plate member and two seats are capable of being used solely or together to vary exercise motions. Furthermore, the seats are placed in the first recesses of the plate member to reduce storing size and to be portable easily.

7 Claims, 18 Drawing Sheets

EXERCISE PEDAL

BACKGROUND OF THE INVENTION

1. Field of the Invention

The present invention relates to an exercise pedal that is capable of varying exercise motions.

2. Description of the Prior Art

As shown in FIG. 1, a conventional exercise pedal comprises a rectangular body 10 including anti-slip patterns formed on a top surface thereof, and two inserting slots arranged on two sides of a bottom surface thereof to be placed on the ground. Thus, the top surface of the exercise pedal serves to be stepped by a user. The body 10 includes two adjustable feet 20 disposed in the inserting slots of the body 10 to be placed on the ground so as to adjust a height of the exercise pedal. However, such a conventional exercise pedal is only used to be stepped upward and downward by the user, like walking on stairs, and has a single function.

The present invention has arisen to mitigate and/or obviate the afore-described disadvantages.

SUMMARY OF THE INVENTION

The primary object of the present invention is to provide an exercise pedal where the plate member and the two seats are capable of being used solely or together to vary exercise motions.

Another object of the present invention is to provide an exercise pedal where the seats are placed in the first recesses of the plate member to reduce storing size and to be portable easily.

An exercise pedal in accordance with a preferred embodiment of the present invention comprises:

a plate member including a receiving cavity fixed on a bottom surface thereof, with the receiving cavity including a plurality of partitions to space a number of recesses;

a seat formed in a semicircle shape and retained to the recesses to be horizontal or to be vertical either upside down or right side up according to the demands of the user;

wherein the plate member includes anti-slip patterns formed on a top surface thereof;

wherein the plate member includes two holes mounted on two sides thereof to retain two flexible ropes respectively;

wherein each flexible rope includes a grip fixed on one end thereof and a hook secured on another end thereof;

wherein the cavity includes a first partition fixed on a central portion thereof, and two second partitions arranged proximate to two ends thereof, wherein between the first partition and the two second partitions are defined first recesses, wherein between the second partitions and two end walls of the receiving cavity are formed two second recesses individually, wherein among the first and the second partitions and two side walls of the receiving cavity are disposed third recesses, and wherein each third recess includes a plurality of spacing pieces to separately form four grooves;

wherein the seat includes two projections disposed on two sides of a bottom surface thereof, and each projection includes a skidproof mat attached thereon;

wherein the seat further includes an anti-slip strap attached on an arcuate surface thereof;

wherein the seat includes a retaining dent mounted between two inner sides of the arcuate surface thereof.

DETAILED DESCRIPTION OF THE PREFERRED EMBODIMENTS

Figure 1:
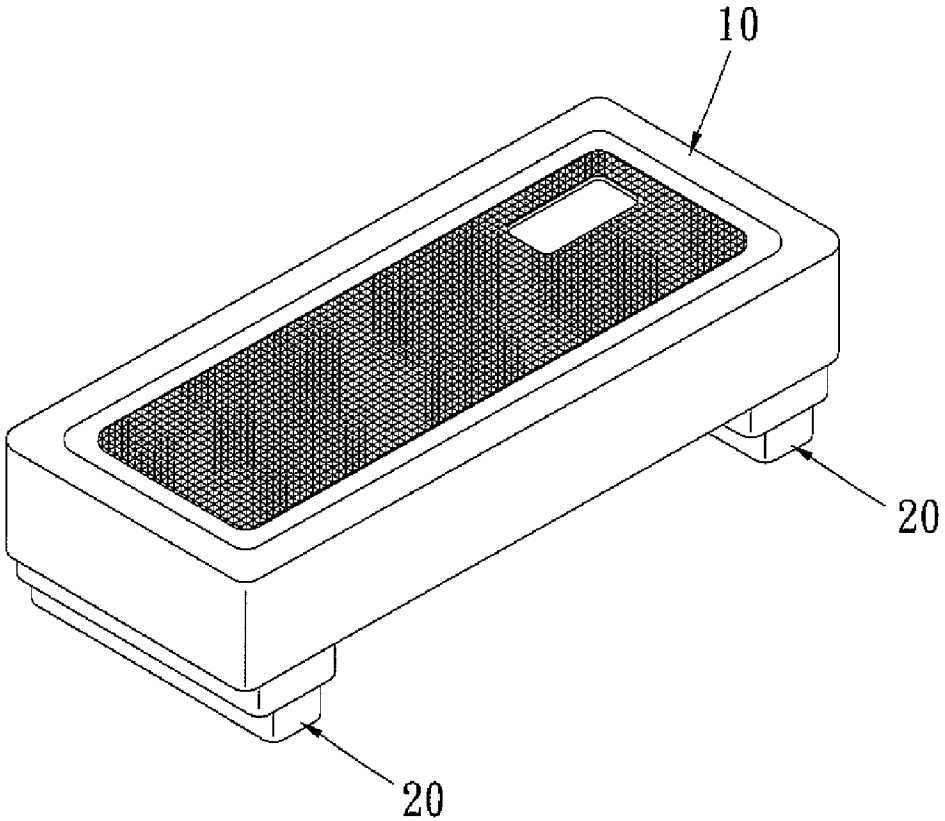
FIG. 1 PRIOR ART
FIG. 1 is a perspective view showing a conventional exercise pedal.
Figure 2:
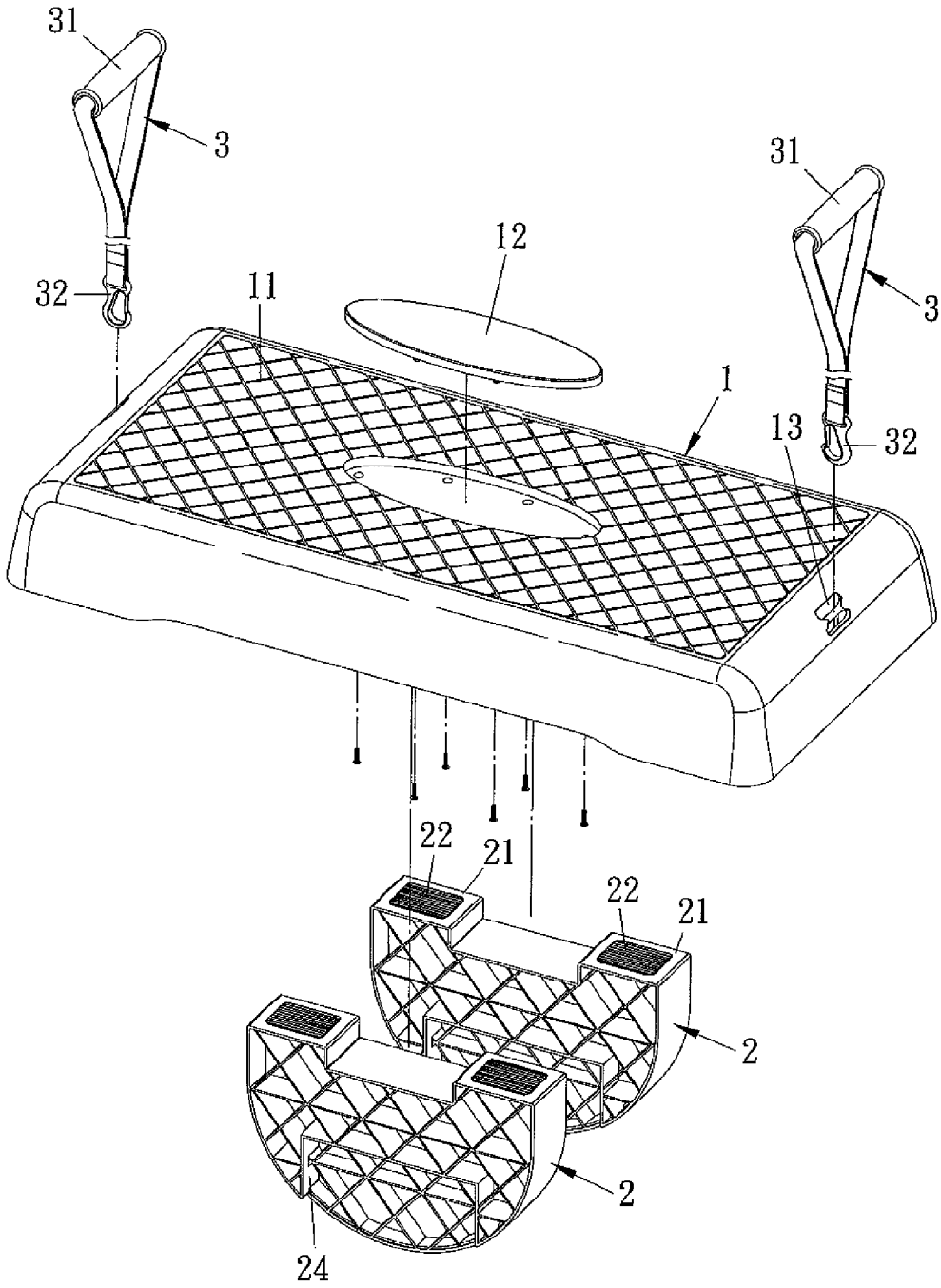
FIG. 2 is a perspective view showing the exploded components of an exercise pedal according to a preferred embodiment of the present invention.
Figure 3:
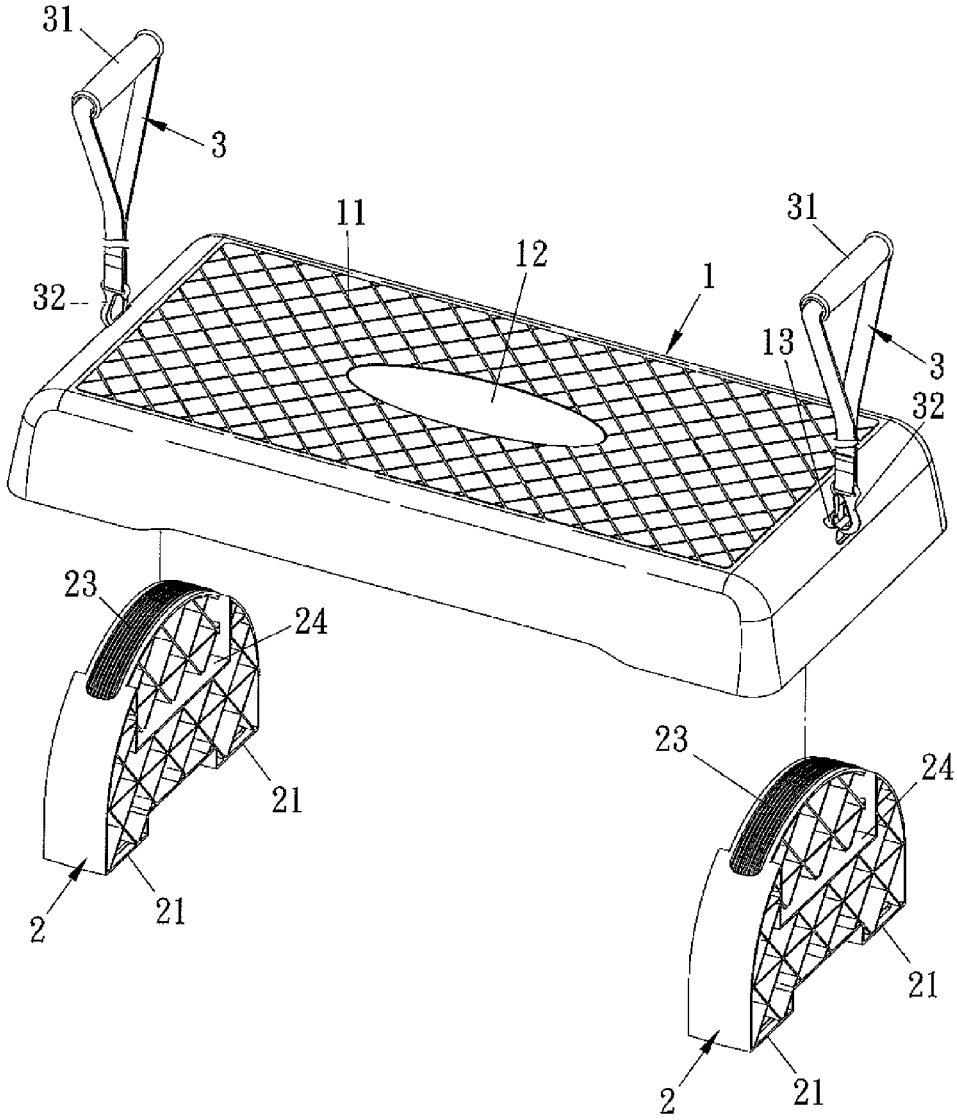
FIG. 3 is another perspective view showing the exploded components of the exercise pedal according to the preferred embodiment of the present invention.
Figure 4:
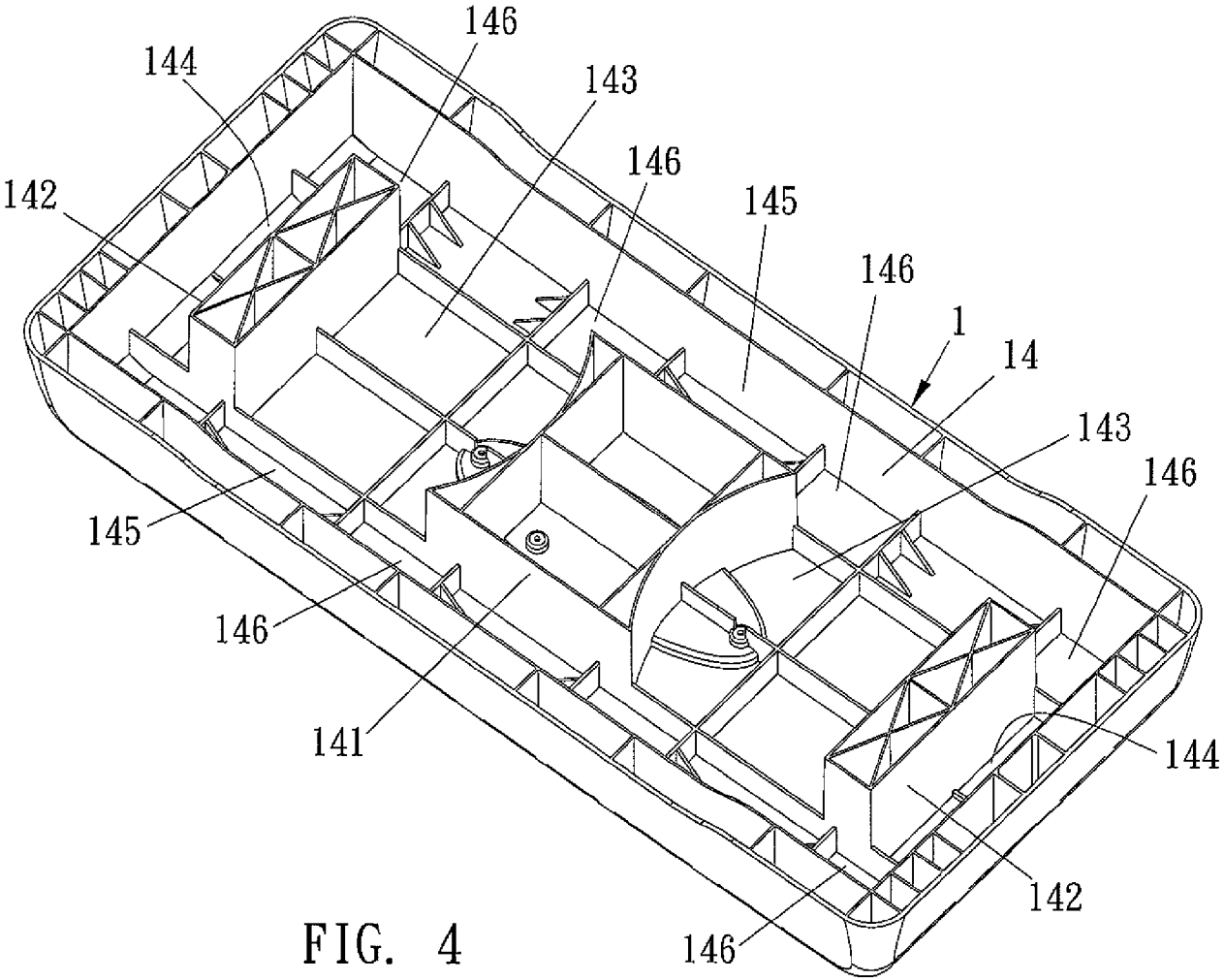
FIG. 4 is a perspective view showing a bottom surface of a plate member of the exercise pedal according to the preferred embodiment of the present invention.
Figure 5:
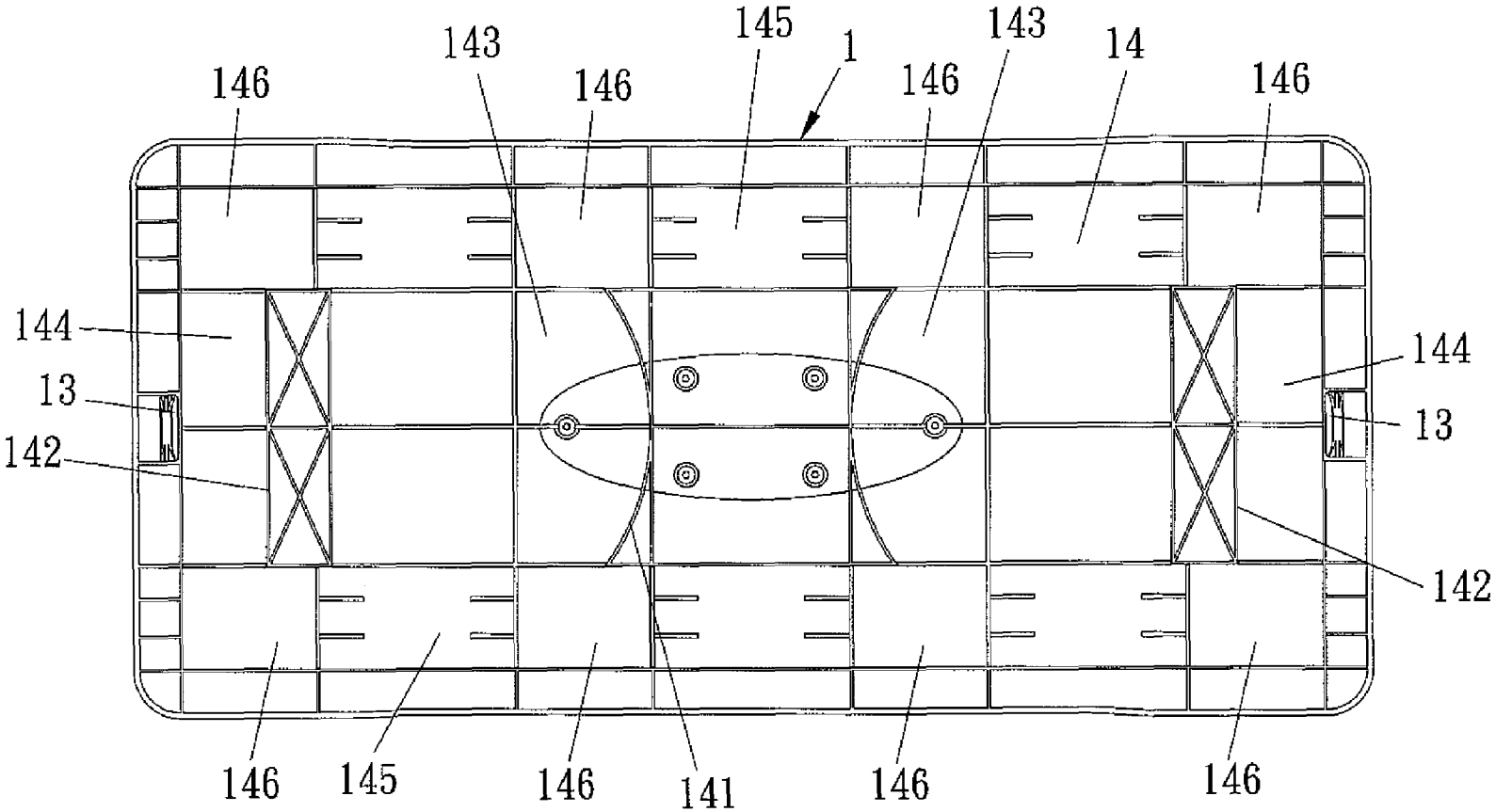
FIG. 5 is a bottom plan view showing the bottom surface of the plate member of the exercise pedal according to the preferred embodiment of the present invention.
Figure 6:
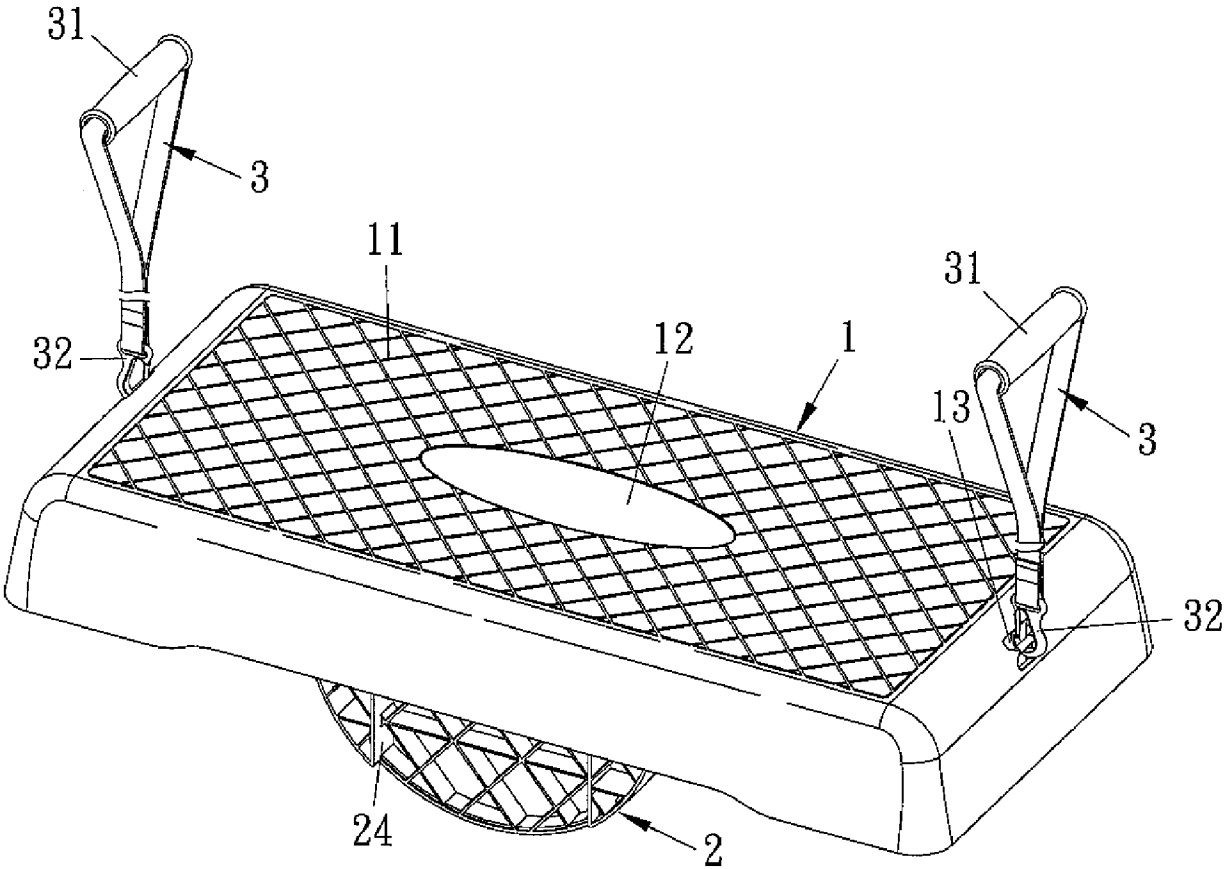
FIG. 6 is a perspective view showing the assembly of the exercise pedal according to the preferred embodiment of the present invention.
Figure 7:
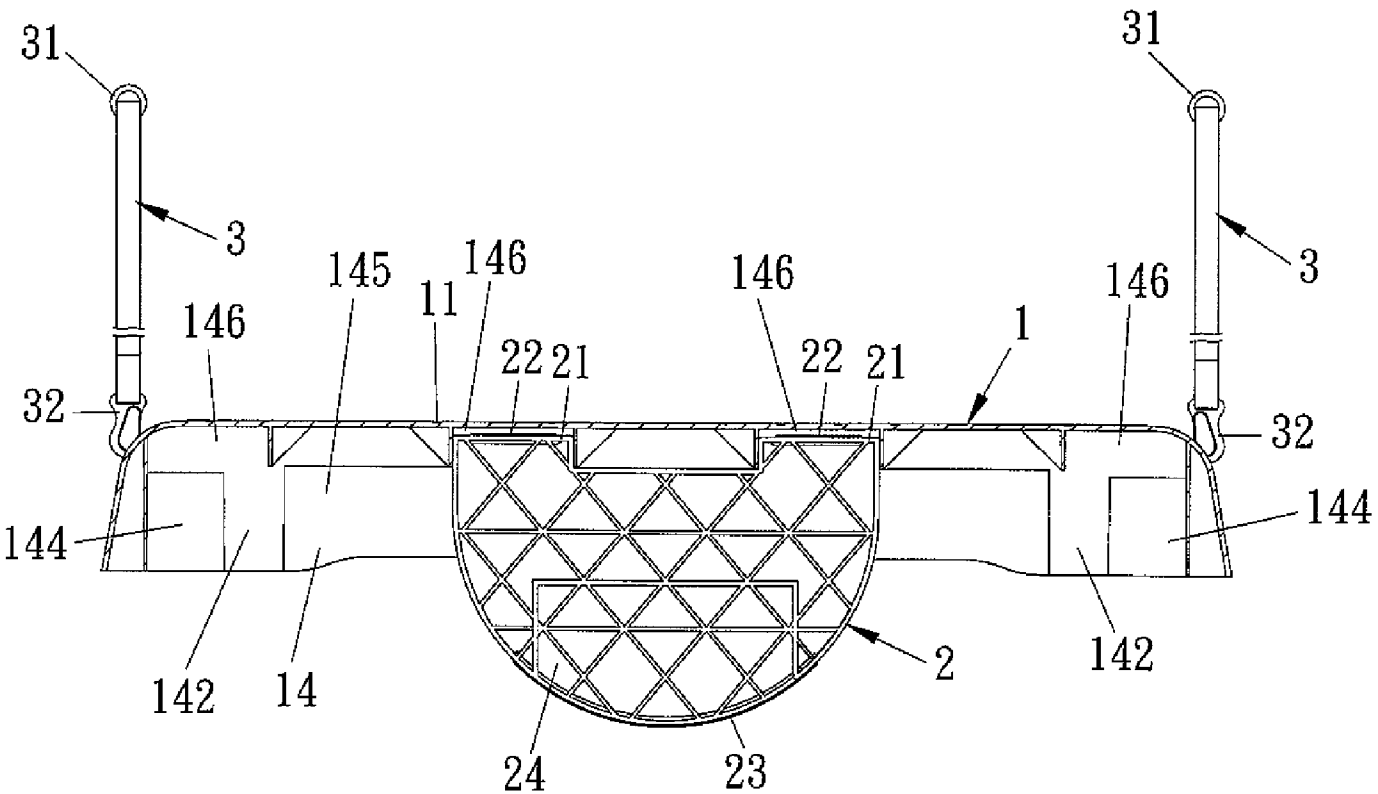
FIG. 7 is a cross sectional view showing the assembly of the exercise pedal according to the preferred embodiment of the present invention.
Figure 8:
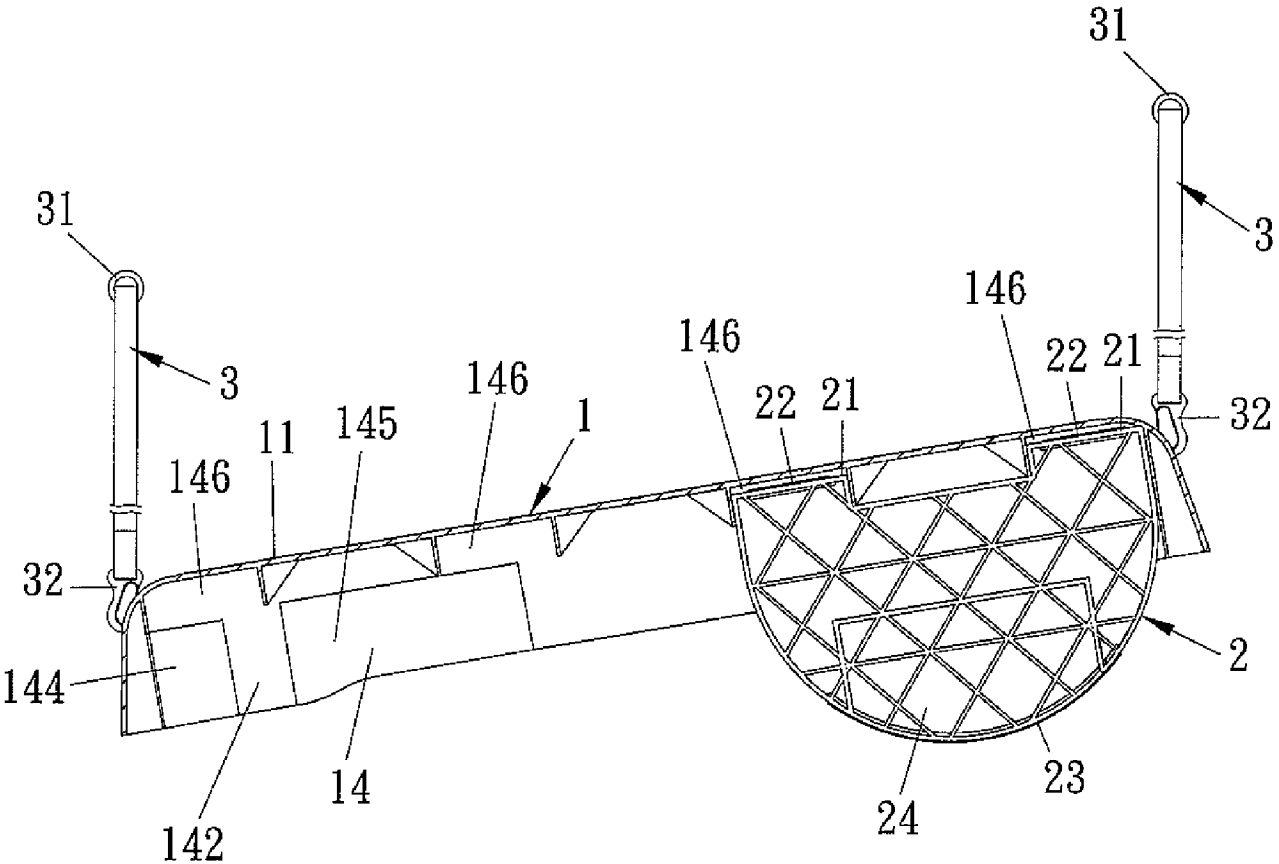
FIG. 8 is another cross sectional view showing the assembly of the exercise pedal according to the preferred embodiment of the present invention.
Figure 9:
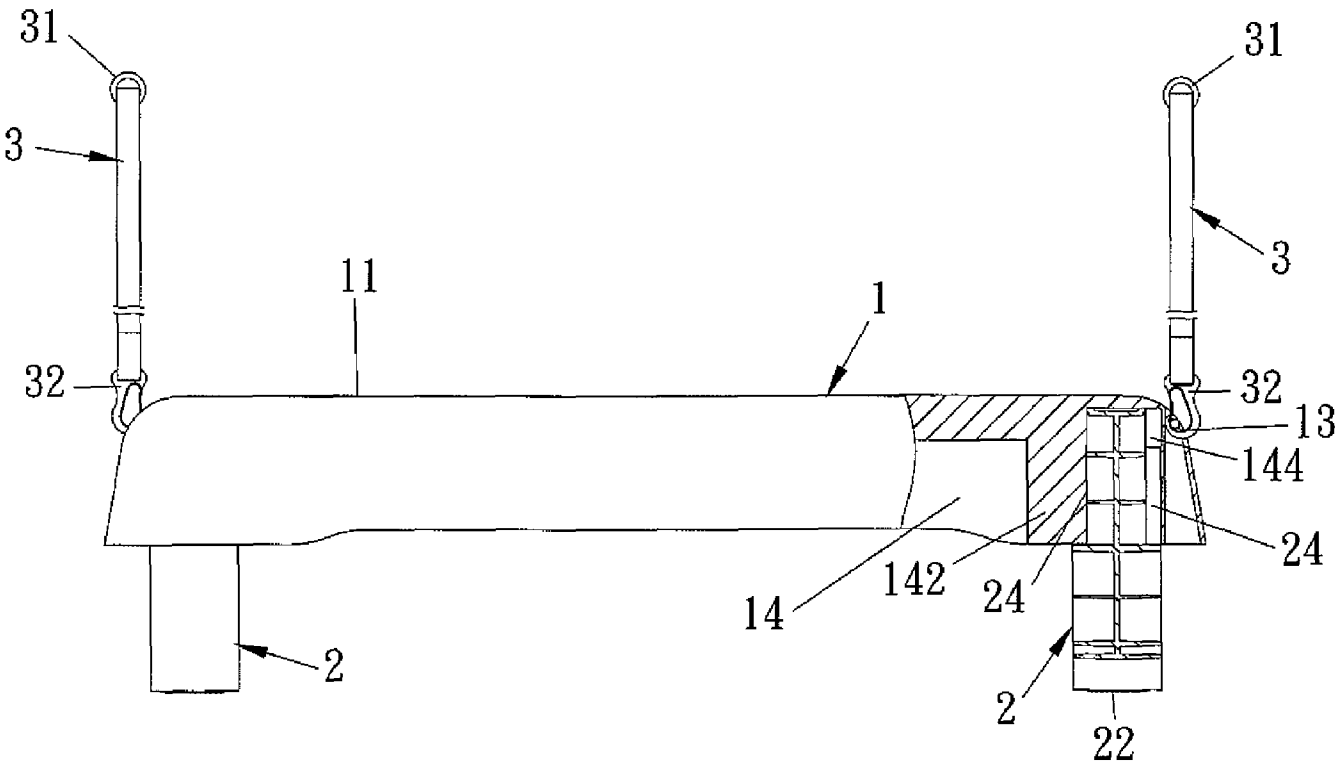
FIG. 9 is also another cross sectional view showing the assembly of the exercise pedal according to the preferred embodiment of the present invention.

The present invention will be clearer from the following description when viewed together with the accompanying drawings, which show, for purpose of illustration only, the preferred embodiments in accordance with the present invention.

Referring to FIGS. 2-9, an exercise pedal in accordance with a preferred embodiment of the present invention comprises a plate member 1, two seats 2, and two flexible ropes 3. The plate member 1 includes anti-slip patterns 11 formed on a top surface thereof, a decorative member 12 disposed at a central portion of the top surface thereof, two holes 13 mounted on two sides thereof respectively, and a receiving cavity 14 fixed on a bottom surface thereof. The receiving cavity 14 includes a first partition 141 fixed on a central portion thereof, and two second partitions 142 arranged proximate to two ends thereof. Between the first partition 141 and the second partitions 142 are defined first recesses 143. Between the second partitions 142 and two end walls of the receiving cavity 14 are formed two second recesses 144 individually. Among the first and the second partitions 141, 142 and two side walls of the receiving cavity 14 are disposed third recesses 145. Each third recess 145 includes a plurality of spacing pieces to separately form four grooves 146.

The seat 2 is formed in a semicircle shape and includes two projections 21 disposed on two sides of a bottom surface thereof. Each projection 21 includes a skidproof mat 22 attached thereon. The seat 2 further includes an anti-slip strap 23 attached on an arcuate surface thereof, and a retaining dent 24 mounted between two inner sides of the arcuate surface thereof. The flexible rope 3 includes a grip 31 fixed on one end thereof and a hook 32 secured on another end thereof.

In use, the two seats 2 are inserted to the third recesses 145 of the plate member 1 so that the projections 21 of the seats 2 are retained in the grooves 146. Hence, the seats 2 are fixed on a middle section of a bottom surface or fixed at two ends of the plate member 1. Alternatively, the two seats 2 are vertically inserted to the second recesses 144 of the plate member 1 so that each retaining dent 24 engages with an end portion of the second partition 142. Hence, the seats 2 are fixed on the two ends of the plate member 1. Furthermore, the hooks 32 of the flexible ropes 3 are retained in the holes 13 of the plate member 1 based on demand of the user.

Figure 10:
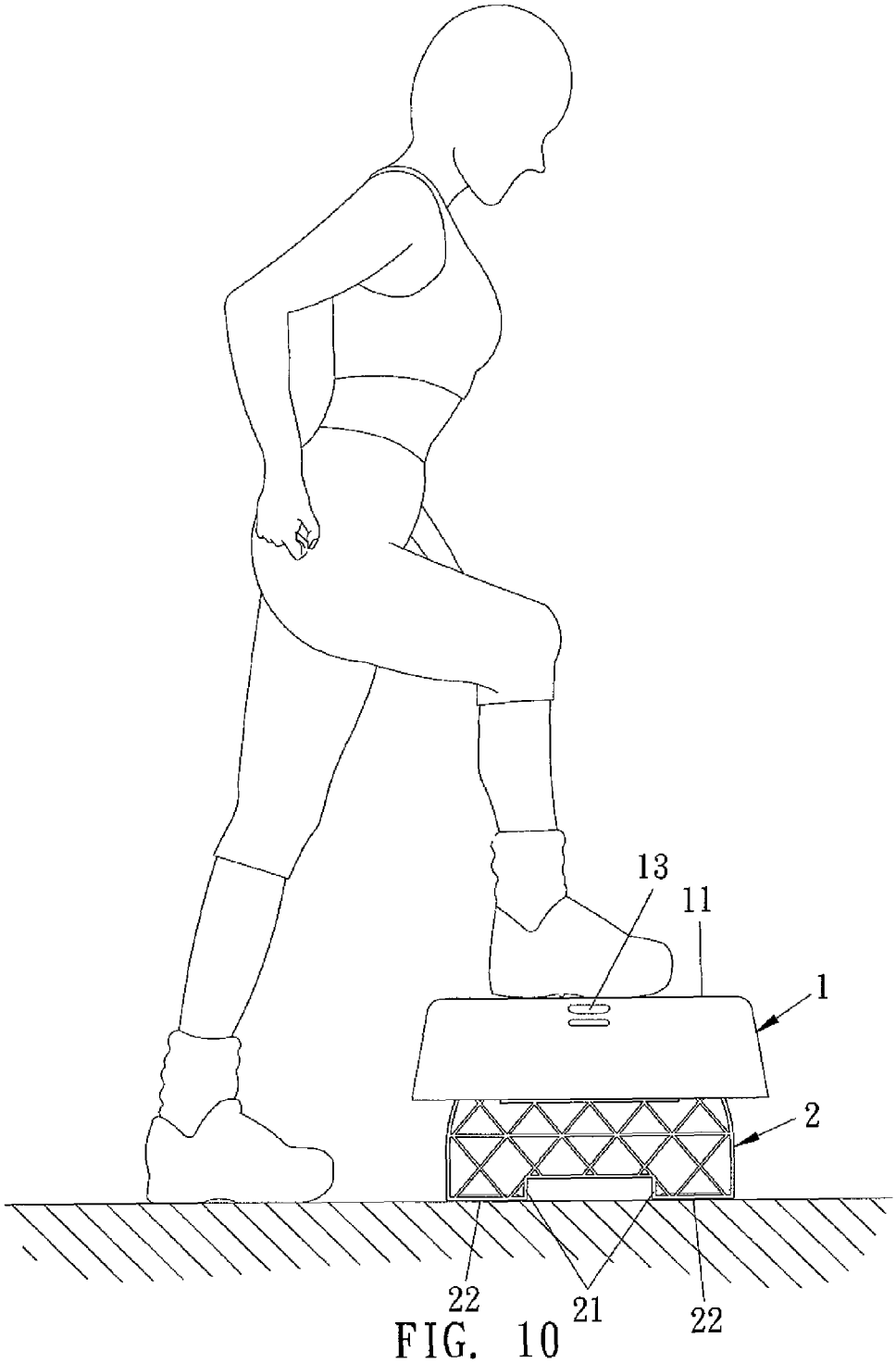
FIG. 10 is a side plan view showing the operation of the exercise pedal according to the preferred embodiment of the present invention.

Referring to FIG. 10, the two seats 2 are vertically fixed on the two ends of the bottom surface of the plate member 1 and use the skidproof mat 22 during stepping on the pedal to prevent accidental sliding.

Figure 11:
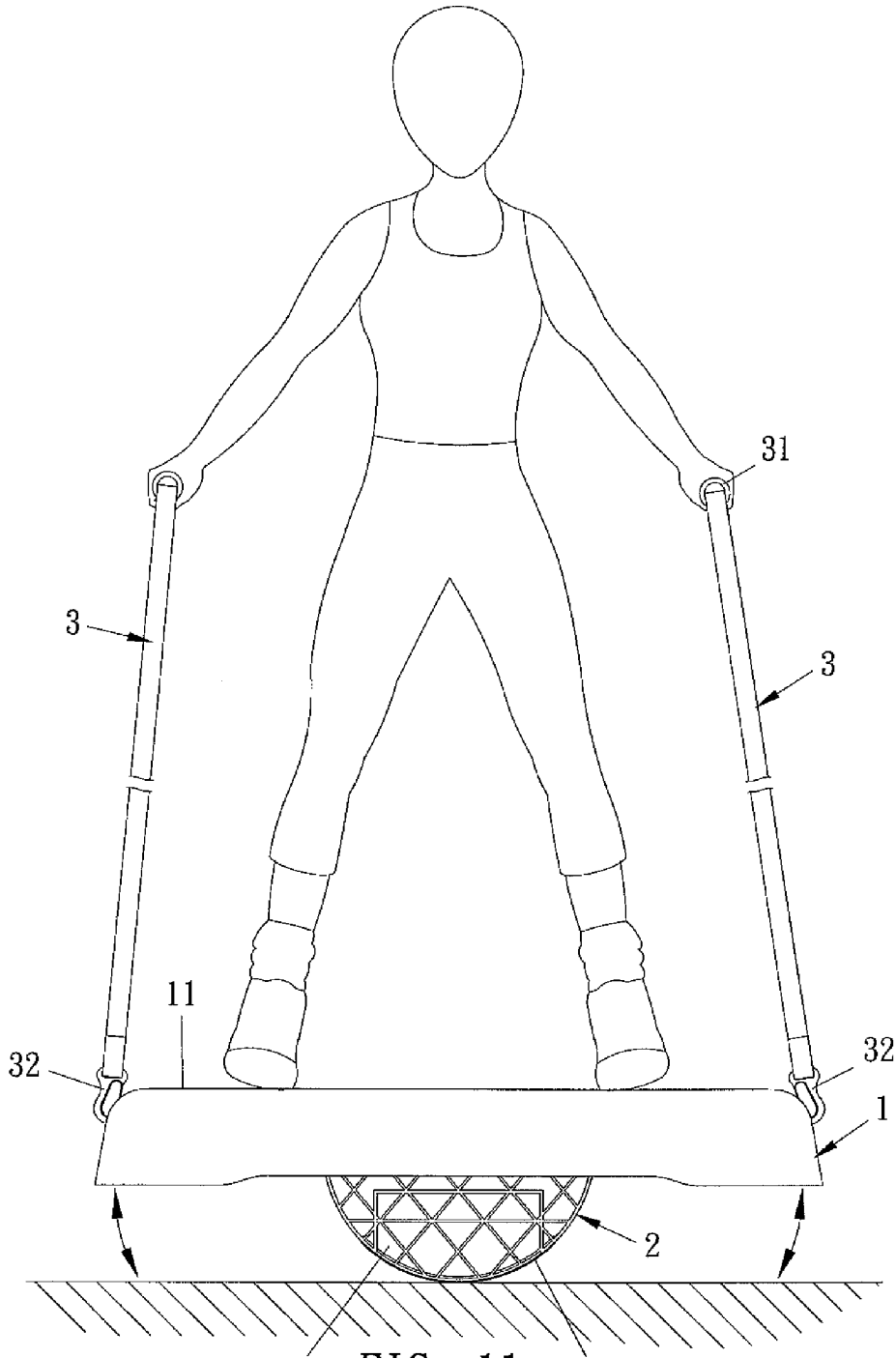
FIG. 11 is a front plan view showing the operation of the exercise pedal according to the preferred embodiment of the present invention.
Figure 12:
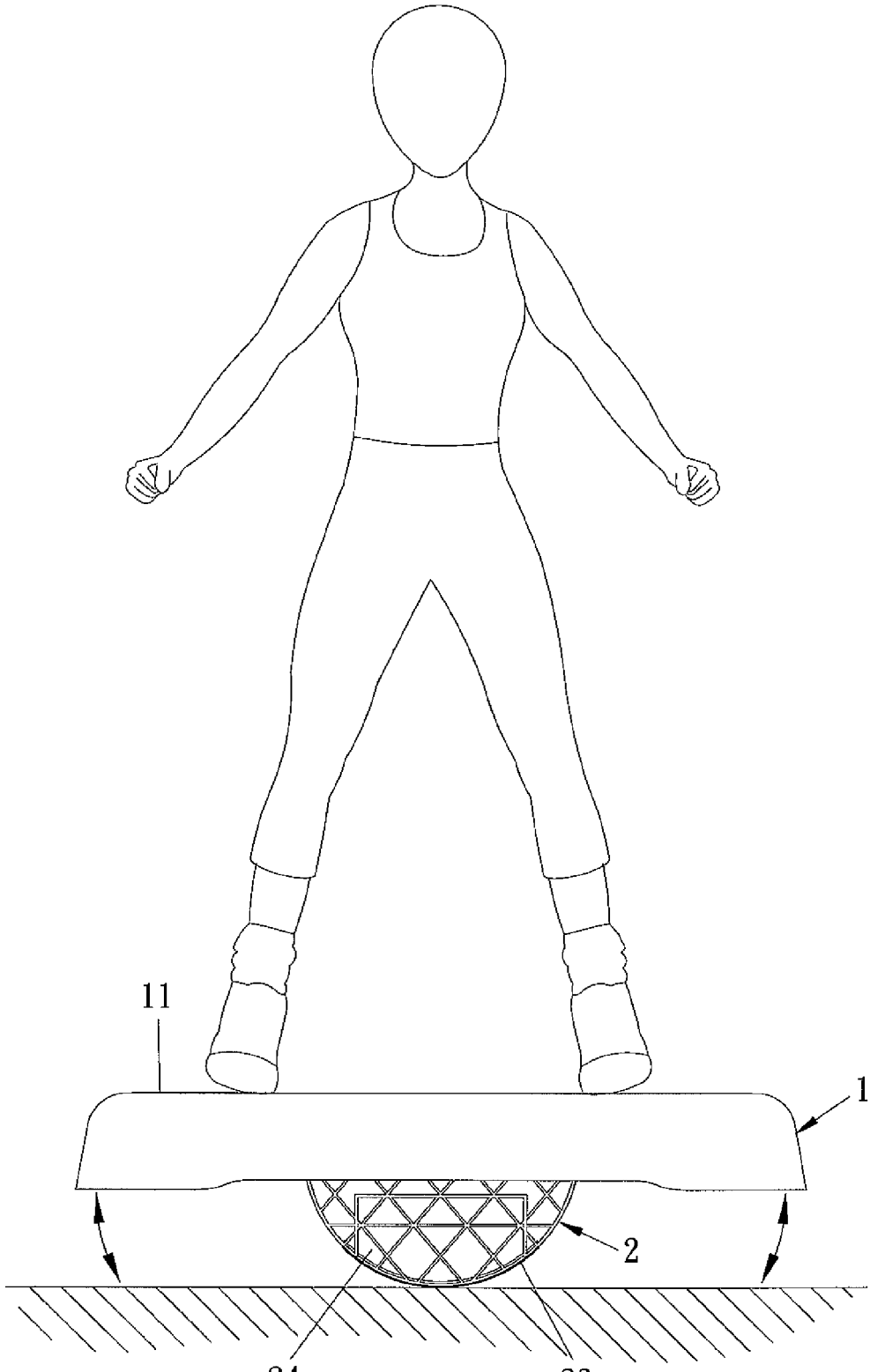
FIG. 12 is another front plan view showing the operation of the exercise pedal according to the preferred embodiment of the present invention.
Figure 13:
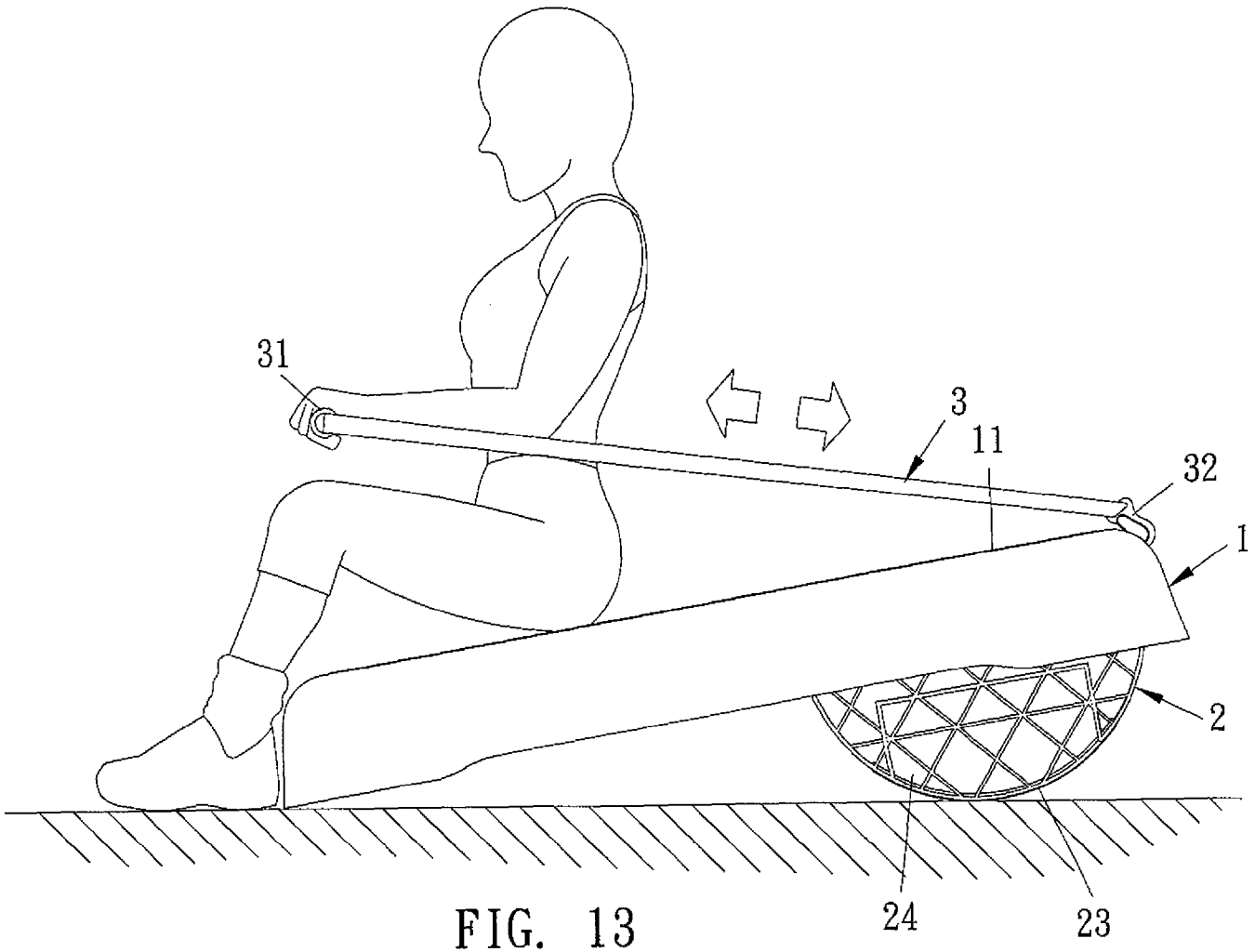
FIG. 13 is another side plan view showing the operation of the exercise pedal according to the preferred embodiment of the present invention.
Figure 14:
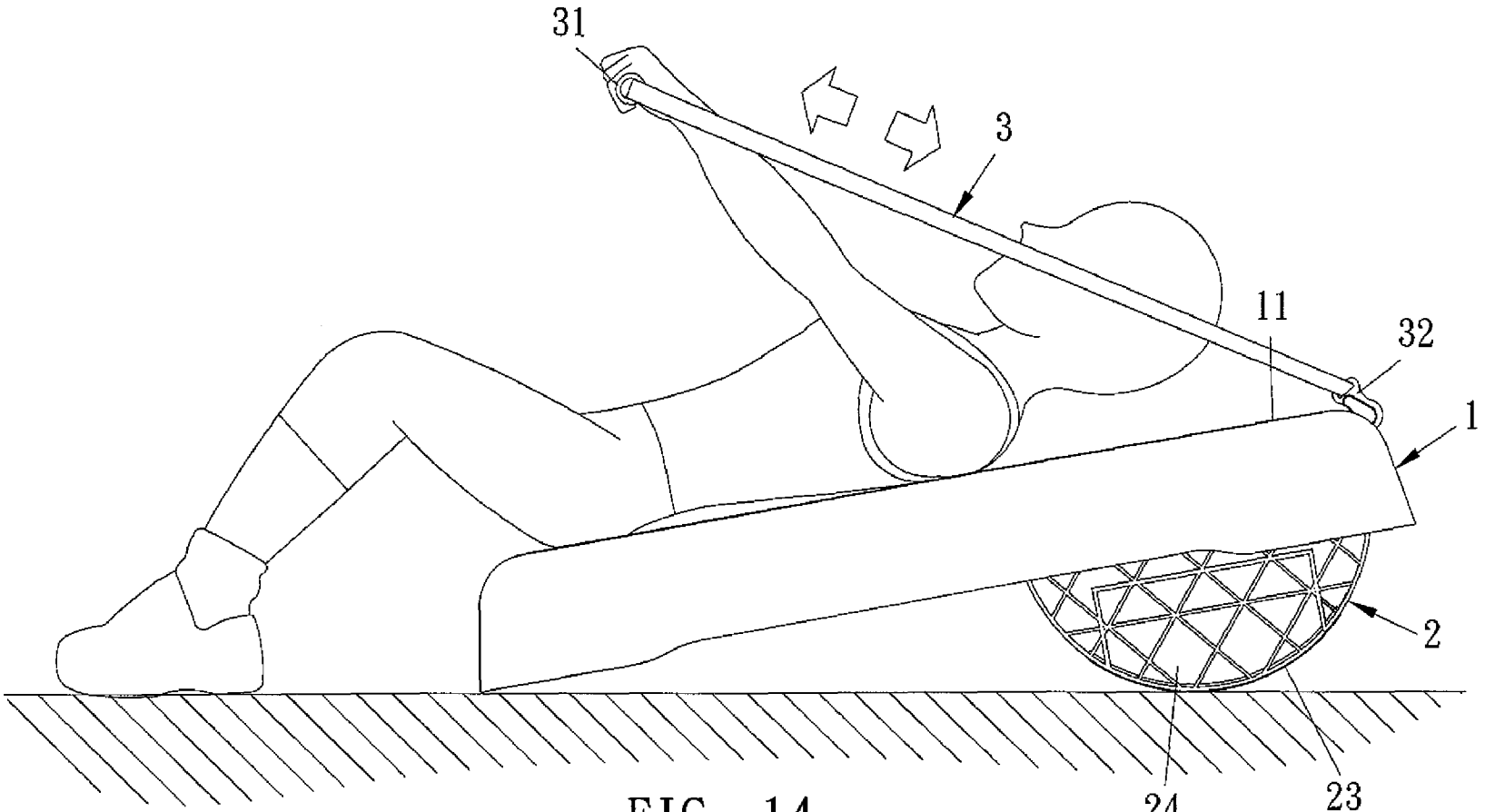
FIG. 14 is also another side plan view showing the operation of the exercise pedal according to the preferred embodiment of the present invention.
Figure 15:
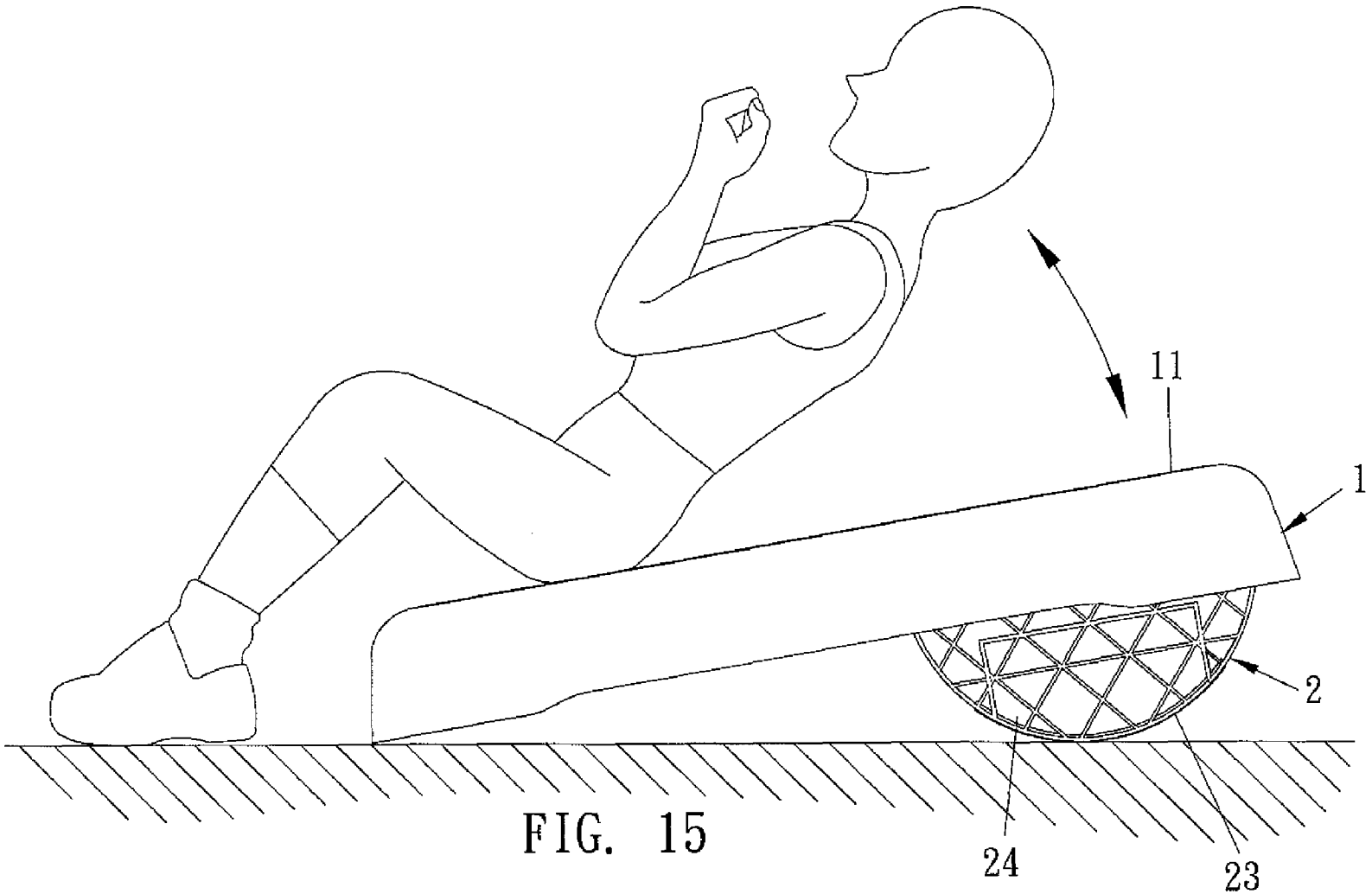
FIG. 15 is another side plan view showing the operation of the exercise pedal according to the preferred embodiment of the present invention.
Figure 16:
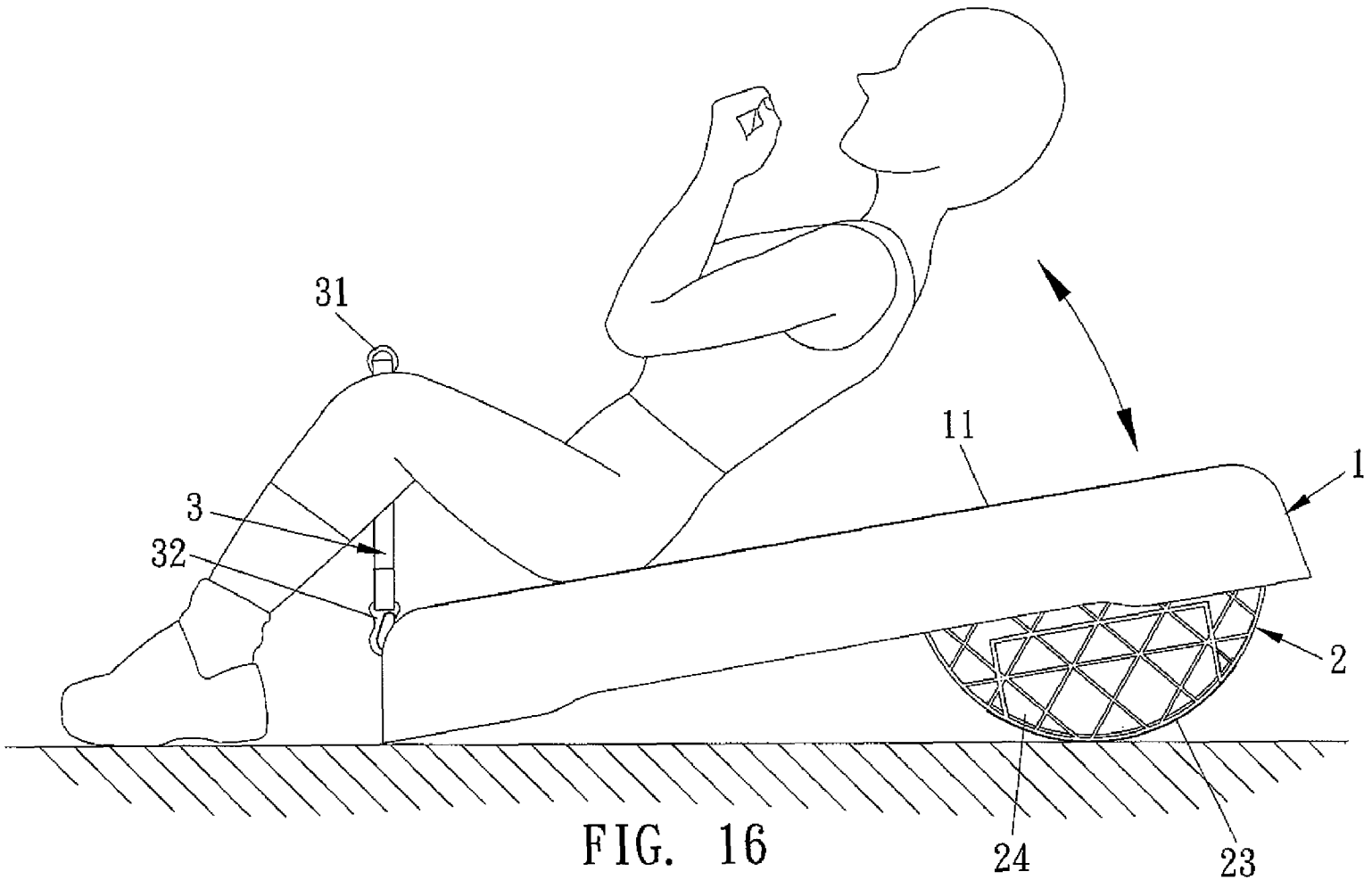
FIG. 16 is another side plan view showing the operation of the exercise pedal according to the preferred embodiment of the present invention.

As shown in FIGS. 11 and 12, the seats 2 are fixed on the middle section of the bottom surface of the plate member 1, and the anti-slip strap 23 of the seat 2 serves to prevent sliding due to a user stepping on two ends of the top surface of the plate member 1. The seat 2 is designed in a semicircle shape. When the user steps on the pedal to swing leftward and rightward, the body can be released and can keep balance, and the buttocks are exercised to have a fitted shape. Besides, the grip 31 of the flexible rope 3 is held by the user to pull the flexible rope 3, thus exercising the hands and upper body.

As illustrated in FIGS. 13-16, the seats 2 are placed upside down to one ends of the two sides of the bottom surface of the plate member 1, and the anti-slip strap 23 is used to prevent the user from sliding. Thus, the plate member 1 becomes tilted so that the user sits or lies on the plate member 1 to exercise with sit-up or waist contracting motions, and the grips 31 of the flexible ropes 3 are held or biased against the legs to exercise the hands and upper body.

Figure 17:
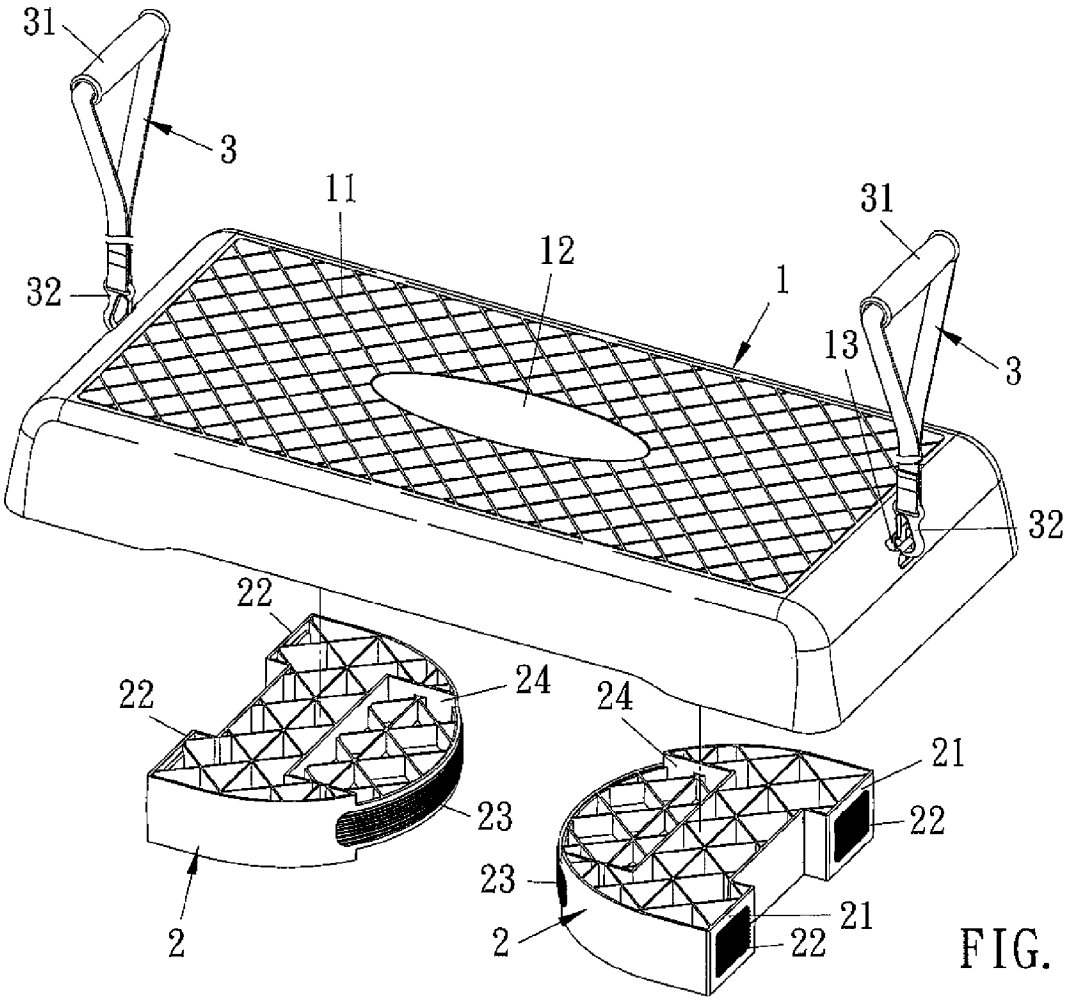
FIG. 17 is a perspective view showing the exercise pedal being stored according to the preferred embodiment of the present invention.
Figure 18:
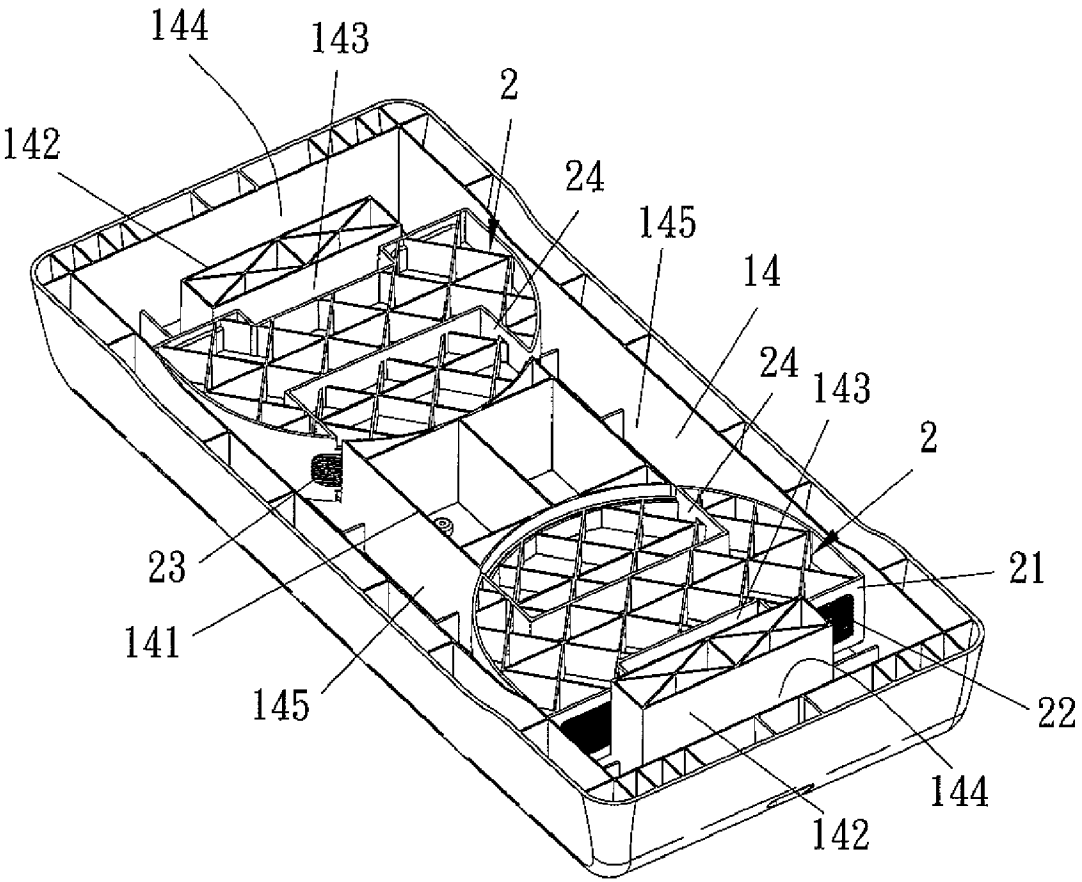
FIG. 18 is a bottom perspective view showing the exercise pedal being stored according to the preferred embodiment of the present invention.

With reference to FIGS. 17 and 18, the seats 2 are horizontally placed to the first recesses 143 of the plate member 1 to reduce storage size and to be portable easily.

Thereby, the exercise pedal of the present invention has the following advantages:

1. The plate member 1 can match with the two seats 2 and or with the flexible ropes 3 to vary exercise motions.

2. The seats 2 are placed in the first recesses 143 of the plate member 1 to reduce storing size and to be portable easily.

While various embodiments have been shown and described in accordance with the present invention, it is clear to those skilled in the art that further embodiments may be made without departing from the scope of the present invention.

What is claimed is:

1. An exercise pedal comprising:

a plate member including a receiving cavity fixed on a bottom surface thereof, with the receiving cavity including a plurality of partitions to space a number of recesses, wherein the cavity includes a first partition fixed on a central portion thereof, and two second partitions arranged proximate to two ends thereof, wherein between the first partition and the two second partitions are defined first recesses, wherein between the two second partitions and two end walls of the receiving cavity are formed two second recesses individually, and wherein among the first and the two second partitions and two side walls of the receiving cavity are disposed third recesses, wherein each third recess includes a plurality of spacing pieces to separately form four grooves; and a seat formed in a semicircle shape and retained to the recesses to be horizontal or to be vertical either upside down or right side up according to demands of a user.

2. The exercise pedal as claimed in claim 1, wherein the plate member includes anti-slip patterns formed on a top surface thereof.

3. The exercise pedal as claimed in claim 1, wherein the plate member includes two holes mounted on two sides thereof to retain two flexible ropes respectively.

4. The exercise pedal as claimed in claim 3, wherein each of the flexible ropes includes a grip fixed on one end thereof and a hook secured on another end thereof.

5. The exercise pedal as claimed in claim 1, wherein the seat includes two projections disposed on two sides of a bottom surface thereof, and each projection includes a skidproof mat attached thereon.

6. The exercise pedal as claimed in claim 1, wherein the seat further includes an anti-slip strap attached on an arcuate surface thereof.

7. The exercise pedal as claimed in claim 1, wherein the seat includes a retaining dent mounted between two inner sides of the arcuate surface thereof.

* * * * *